United States Patent [19]

Klett et al.

[11] Patent Number: 5,009,932

[45] **Date of Patent: * Apr. 23, 1991**

[54] METHOD AND APPARATUS FOR IMPREGNATING A POROUS SUBSTRATE WITH FOAM

[75] Inventors: Paul A. Klett, Newark; Shiv K. Bakhshi, Columbus; Steven B. Stahl, Granville, all of Ohio

[73] Assignee: Owens-Corning Fiberglas Corporation, Toledo, Ohio

[ * ] Notice: The portion of the term of this patent subsequent to Apr. 16, 2008 has been disclaimed.

[21] Appl. No.: 388,284

[22] Filed: Jun. 14, 1982

[51] Int. Cl.[5] ..... B05D 1/26; B05D 3/06; B05C 3/00; B05C 3/18

[52] U.S. Cl. ..... 427/243; 427/209; 8/477; 68/200; 118/44; 118/410; 118/411; 118/415

[58] Field of Search ..... 118/410, 411, 412, 44, 118/50, 46, 415; 427/244, 294, 296, 373, 243, 209; 8/477; 68/200

[56] References Cited

U.S. PATENT DOCUMENTS

| | | | |
|---|---|---|---|
| 3,084,661 | 4/1963 | Roberts | 118/50 |
| 3,533,834 | 10/1970 | Marzocchi | 427/296 |
| 3,738,265 | 6/1973 | Saueressig | 118/46 X |
| 3,969,780 | 7/1976 | Henderson | 8/149.1 |
| 4,023,526 | 5/1977 | Ashmus et al. | 118/410 |
| 4,090,469 | 5/1978 | Roberts, Jr. | 118/410 |
| 4,188,355 | 2/1980 | Graham et al. | 264/26 |
| 4,237,818 | 12/1980 | Clifford et al. | 118/410 |
| 4,288,475 | 9/1981 | Meeker | 427/294 |
| 4,305,169 | 12/1981 | Vidalis | 118/410 X |

OTHER PUBLICATIONS

"Foam Processing for Dyeing and Finishing," Shirley Institute Publication S42, Apr. 15, 1981, Didsbury, Manchester, U.K.

*Primary Examiner*—Evan K. Lawrence

*Attorney, Agent, or Firm*—Ted C. Gillespie; Michelle N. Lester

[57] ABSTRACT

A method and apparatus for impregnating a porous substrate with foam, the method comprising transporting the porous substrate through a nip region defined by a rotating foraminous drum and a foam discharge head, the foam discharge head comprising one or more discharge openings, supplying foam to the discharge head with pressure sufficient to discharge foam through the discharge openings to impregnate the porous substrate, and urging the foam discharge head and the foraminous drum toward each other to compress the porous substrate as it passes the discharge openings. The foam discharge head is mounted to a hinged plate to enable the urging of the discharge head toward the foraminous drum.

10 Claims, 1 Drawing Sheet

METHOD AND APPARATUS FOR IMPREGNATING A POROUS SUBSTRATE WITH FOAM

TECHNICAL FIELD

This invention pertains to treating a porous substrate by impregnating the substrate with a foam. In one of its more specific aspects, this invention relates to transporting a porous substrate past an applicator which injects foam into the porous substrate, thereby impregnating or coating the porous substrate.

BACKGROUND OF THE INVENTION

A common practice in the manufacture of porous substrates is to apply a coating of various materials thereto In the manufacture of carpet material, for example, it is necessary to dye the carpet to the desired color during the manufacturing process. Also, many types of fibrous and non-fibrous webs or blankets require a binder to bond the fibers or other particles together to form a cohesive product. An example of this is an insulation pack produced by bonding together mineral fibers, such as glass fibers. A typical binder for a glass fiber insulation pack is a phenol-formaldehyde-urea binder. The binder is applied to the fibers, and, when cured, the binder enables the insulation pack to be compressed with nearly full recovery upon release of the compression.

Previously, the application of binder, dye or any other coating material to porous substrates, such as carpets or mineral fiber webs, has been by one of several methods. The common method in the manufacture of mineral fiber packs is to spray a binder material or coating material onto the fibers prior to collecting the fibers in the form of an insulation pack. This process has certain deficiencies in that the binder has to be applied in a hot fiber-forming zone, thereby creating air pollution problems. Also, binder application onto air-borne fibers is inherently non-uniform. Another process for applying coatings to porous substrates is that of transporting the substrate through a liquid bath, such as is used to dye fabrics, including carpets. This process is deficient in that a large percentage of water or other carrier medium remains in the porous substrate after the coating process, and must be removed by costly methods, such as by drying ovens. Also, liquid bath applicators provide no control of penetration of the liquid into the substrate.

Another method for coating porous substrates is that of creating a foam containing the coating material, such as the binder or the dye, and impregnating the porous material with the foam. The use of the foam material facilitates a uniform coating on all the material of the substrate, and applies the coating with a minimum amount of carrier medium, such as water. Typically, the foams are applied as a layer to the substrate, and caused to impregnate the substrate by the use of a doctor blade. Another process for forcing a layer of foam into a porous substrate is disclosed in U.S. Pat. No. 4,188,355, to Graham et al., which provides for a suction apparatus to force the binder foam into the insulation pack. The use of a suction device to force the foam into the pack is not entirely satisfactory, however. There is an inherent difficulty in transporting a fragile pack of fibers having low tensile strength through a narrow opening and past a foam applicator. Also, suction devices are limited in not being able to produce any pressures higher than one atmosphere. There is a need for a method and apparatus for applying foam to a porous substrate in the absence of a vacuum apparatus, which is inherently pressure limited.

SUMMARY OF THE INVENTION

There has now been developed a method and apparatus for applying foam to a porous substrate in which the substrate is passed through a nip region defined by a foraminous conveyer and the surface plate of a foam discharge head. The function of the foraminous surface is to press the insulation material down tight against the surface plate and the discharge openings, thereby sealing the surface plate and insuring that the foam will pass directly into the insulation pack rather than leaking along the interface between the surface plate and the insulation pack Such a pressure device has two requirements. First, it must not create so much friction between the insulation material and the surface plate that the insulation material cannot be transported past the foam discharge head. The friction which can be tolerated by any particular porous substrate is a function of the tensile strength of that porous substrate. Also, the foraminous nature of the surface enables air to escape from the pack during the compression process. The pressurized foam is able to partially or fully impregnate the insulation pack, and the compression at the nip region insures that the foam material will pass through the surface and into the interior of the insulation pack rather than travel along the interface between the insulation pack and the discharge head. The foraminous surface and the foam discharge head can be urged toward each other to compress the substrate to seal against leakage of the foam, and the amount of compressive force applied to the substrate can be controlled.

According to this invention, there is provided apparatus for impregnating a porous substrate with a foam comprising a foam discharge head having a surface plate adapted with one or more discharge openings for the discharge of foam therethrough, a foraminous surface positioned opposite the discharge openings to define a nip region, with the foraminous surface being adapted to transport the porous substrate through the nip region, means for supplying foam to the foam discharge head with pressure sufficient to discharge foam through the discharge openings to impregnate the porous substrate, and means for urging the foam discharge head toward the foraminous surface to urge the porous substrate into sealed relation with the surface plate so that foam is prevented from accumulating at the interface of the foam discharge head and the porous substrate as the porous substrate is transported through the nip region. The means for urging can also be adapted to urge the foraminous surface toward the foam discharge head.

In a specific embodiment of the invention, the foam discharge head is mounted on a hinged plate.

In a preferred embodiment of the invention the means for urging comprises a pneumatic means.

In the most preferred embodiment of the invention there is provided means for controlling the force applied to the porous substrate by the means for urging.

According to this invention, there is also provided a method for impregnating a porous substrate with a foam comprising transporting the porous substrate through a nip region defined by a foraminous surface and a foam discharge head, the foam discharge head comprising a surface plate adapted with one or more discharge openings, where the transport of the porous substrate through the nip region causes the porous substrate to be compressed as it passes the discharge openings, supplying foam to the discharge head with pressure sufficient to discharge foam through the discharge openings to impregnate the porous substrate, and urging the foam discharge head toward the foraminous surface to urge the porous substrate into sealed relation with the surface plate to prevent foam from accumulating at the interface between the foam discharge head and the porous substrate as the porous substrate is transported through the nip region. Alternatively, the foraminous surface can be urged toward the foam discharge head.

In a preferred embodiment of the invention, the force applied to the porous substrate by the urging means is controlled.

DESCRIPTION OF THE INVENTION

This invention will be described in terms of a method and apparatus for applying a binder foam to an insulation pack of glass fibers. It is to be understood that the invention can be practiced with other coating materials, such as dyes, sizes, lubricants, finishes, oils, waxes, asphalts, latex materials and paints, and with other porous substrates, such as insulation packs of other mineral fibers, paper products, polymer products, and textile material, such as carpeting.

Figure 1:
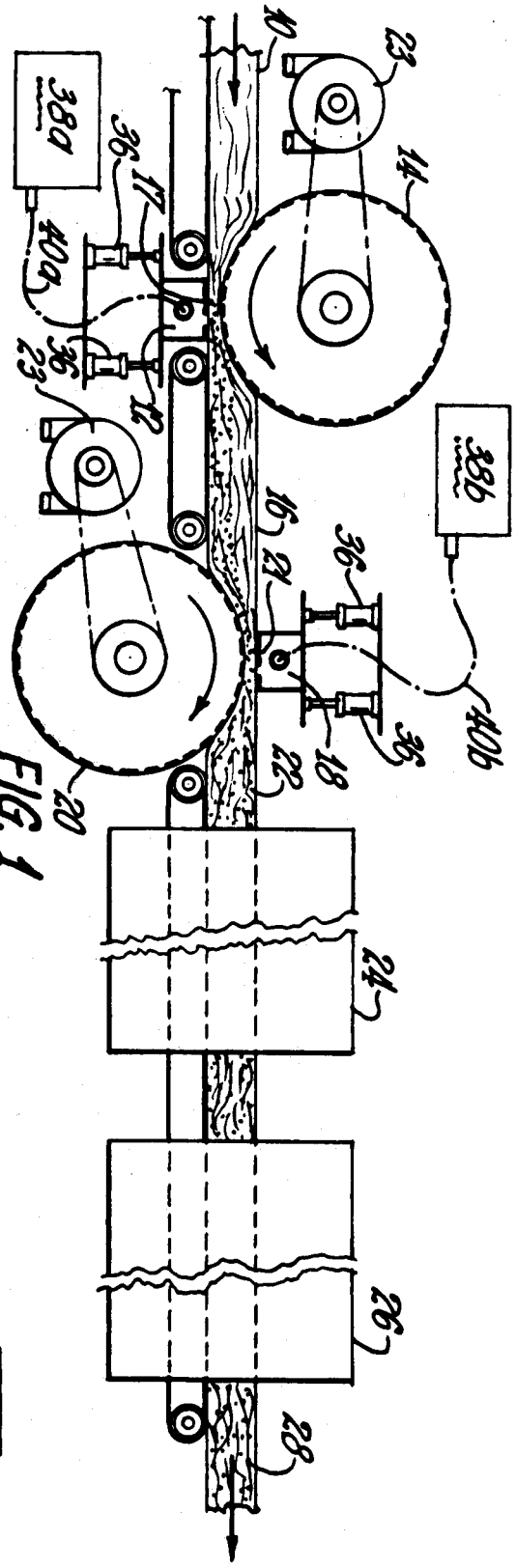
FIG. 1 is a schematic view in elevation of apparatus for impregnating a porous substrate with a foam according to the principles of this invention.
Figure 2:
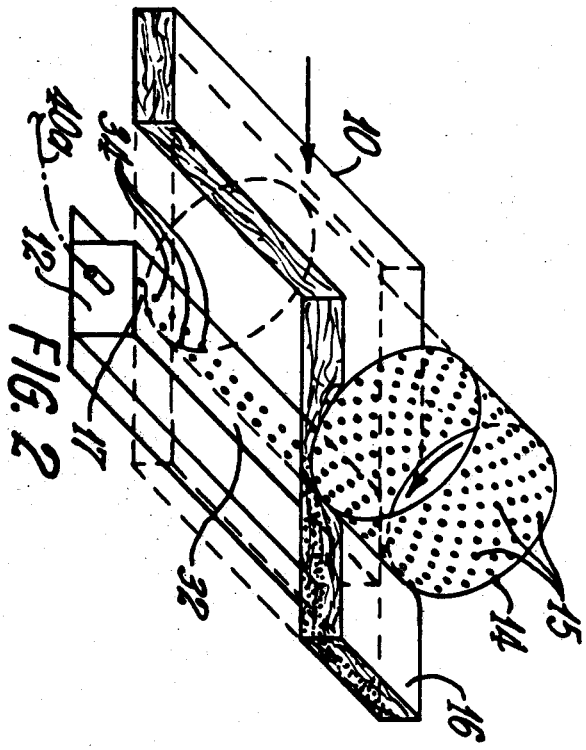
FIG. 2 is a schematic view in perspective of the apparatus shown in FIG. 1.

As shown in FIGS. 1 and 2, the unimpregnated porous substrate, such as glass fiber insulation pack 10, is driven past bottom foam discharge head 12 by a foraminous surface, such as first rotating foraminous drum 14. The foraminous drum can be made of any suitable material, such as stainless steel, and is adapted with a plurality of perforations, such as perforations 15. Preferably, the perforations give the drum a porosity of about 0.5. The positioning of the first foraminous drum opposite the foam discharge head defines nip region 17 through which the insulation material must pass. Preferably, the foraminous surface, such as the foraminous drum, is convex within the nip region in the direction of the foam discharge head, i.e., in a downward direction for the apparatus shown in FIGS. 2 and 3. In the nip region, the insulation material is considerably compressed, as shown. Preferably, the insulation material is compressed in the nip region to a thickness within the range of from about 5 to about 20 percent of the thickness of the uncompressed insulation material.

The partially impregnated insulation pack 16 can then be drawn past another foam application station, which can be comprised of top foam discharge head 18 and second rotating foraminous drum 20 to produce fully impregnated insulation pack 22. In the alternative, any number of foam application stations can be employed for either the top or bottom (or both) of the porous substrate. As shown in FIG. 2, nip region 21 is defined by the positioning of the second foraminous drum adjacent the top foam discharge head. The foraminous drums can be driven by any suitable means, such as motors 23. The fully impregnated pack can then be passed through a dryer, such as radio-frequency dryer 24, which can remove water from the impregnated pack without curing the binder. Subsequently, either in an on-line operation or in an off-line operation, the impregnated, dried insulation pack can be passed through a curing station, such as curing oven 26, to produce cured insulation product 28. Alternatively, the dried, uncured insulation material can be molded using conventional wool molding techniques for such uses as automobile hoodliners and headliners.

The foam discharge head is adapted with surface plate 32 across which the insulation pack is transported. Preferably, the surface plate and other parts of the foam discharge head is comprised of stainless steel, or some other wear-resistant, corrosion-resistant material. The surface plate is adapted with a plurality of discharge openings 34 for dispensing foam from the foam discharge head into the insulation pack. The discharge openings can comprise a single slot, not shown. Preferably, the discharge openings comprise a plurality of holes, and preferably they are arranged in two or more rows, with the holes in one row being offset or staggered from the holes in another row. This provides the most uniform coverage of the foam across the width of the insulation pack, without providing holes so large as to enable the compressed insulation material to be torn by being forced into the holes, or catching on the hole edges.

Since the nip region has a minimum thickness less than the thickness of the insulation material, the insulation material is urged into sealed relation with the surface plate so that the foam is prevented from accumulating on the interface of the surface plate and the insulation material. The foam is substantially prevented from leaking or traveling laterally along the surface plate, and is forced to impregnate or penetrate into the insulation material.

The foam discharge heads can be supplied with the binder foam from foamers 38*a* and 38*b* via any suitable means, such as hoses 40*a* and 40*b*. A mechanical foamer that has been found suitable for use for the invention is a 14 inch foamer manufactured by Oakes Corporation, Islip, New York. Such a foamer can produce the binder foam at a pressure within the range from about 40 to about 100 psig, or higher. The foam pressure within the foam discharge head is limited only by the construction materials and the foam delivery capacity. Preferably the pressure is within the range of from about 3 to about 18 psig, and most preferably within the range from about 5 to about 10 psig. The pressure reduction from the foamer to the foam discharge head is provided by the hoses, and different size and length hoses can be used to produce the desired pressure drop. The pressure developed in the foam discharge head is dependent on the product produced and on the nature of the foam. The foam within the foam discharge head can have a density within the range of 0.01 g/cc to 0.05 g/cc or higher, and preferably, 0.03 g/cc (densities calculated at atmospheric pressure).

The foam discharge head is adapted with means for urging which can urge the foraminous drum toward the foam discharge head, or urge the foam discharge head toward the foraminous drum, or urge both towards each other. The means for urging can be either hydraulic means, springs or, preferably, pneumatic means 36 to accommodate solid or incompressible objects, such as glass slugs or density variations in the glass insulation pack, passing through the nip region between the foam discharge head and the foraminous drum. The pneumatic means also accommodate eccentricities in the foraminous drum.

Figure 3:
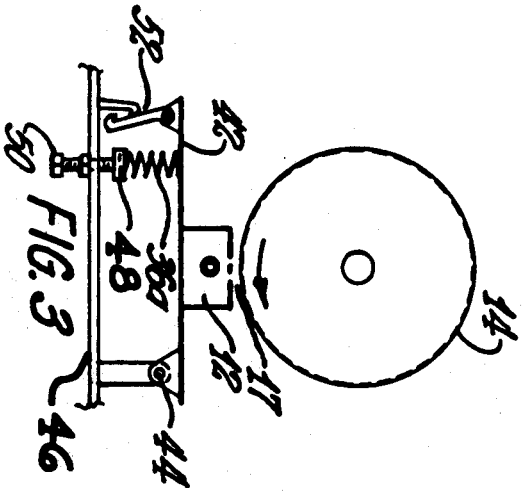
FIG. 3 is a view in elevation of a different embodiment of the means for urging the foam discharge head toward the foraminous drum.

As shown in FIG. 3 the foam discharge head can be mounted on hinged plate 42, the plate being pivotable about pivot pin 44. The urging means can be spring 36a which pushes up from base plate 46 to urge the foam discharge head toward the foraminous drum to compress the insulation pack.

The spring can be mounted in mounting cup 48, which can be adjusted vertically by threaded member 50 in order to control the force applied to the insulation pack. The hinged plate can be connected to the base plate by detent means 52 to prevent closing the nip region below a minimum clearance.

Figure 4:
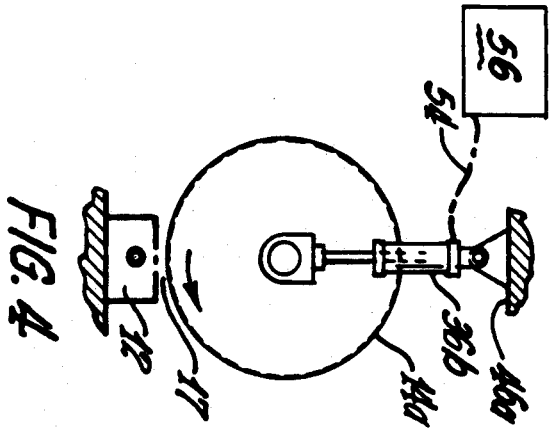
FIG. 4 is a view in elevation of another embodiment of the means for urging the foraminous drum toward the foam discharge head.

As shown in FIG. 4, the foraminous drum 14a an be mounted from base plate 46a, and adapted with pneumatic cylinders 36b as the means for urging the foraminous drum toward the foam discharge head. The pneumatic cylinders can be supplied with pressurized air via air line 54. Controller 56, which can be a valve, can control the air pressure in the pneumatic cylinders, and hence the force applied to the insulation pack.

EXAMPLE

A dry 2-inch thick, 1 pcf glass fiber insulation pack having an initial binder content of 2 percent by weight was subjected to binder foam impregnation according to the principles of this invention. A foam binder material was prepared using an aqueous phenol-formaldehydeurea resin with 2 percent by weight of Union Carbide's TERGITOL IP-10 as a foaming agent, and was applied to the insulation material with the apparatus of this invention using both a bottom and a top application. The minimum thickness of the nip region was about ⅜ inch, the foam pressure in the discharge head was about 5 psig, and the foam density was about 0.03 g/cc. The pressure applied to the insulation pack was about 21 pounds per lineal inch width of the pack. The impregnated pack was placed in a radio-frequency dryer which removed substantially all of the water, resulting in an uncured product having about 20 percent binder by weight. Subsequently, the product was cured in a mold to make a final product having a thickness of about ¾ inch.

It will be evident from the foregoing that various modifications can be made to this invention. Such, however, are considered as being within the scope of the invention.

INDUSTRIAL APPLICABILITY

This invention will be found to be useful in the manufacture of packs of mineral fibers for such uses as glass fiber thermal insulation products, and for the manufacture of textile material.

I claim:

1. Apparatus for impregnating a porous substrate with a foam comprising a foam discharge head having a surface plate adapted with one or more discharge openings for the discharge of foam therethrough, a foraminous surface positioned opposite said discharge openings to define a nip region, said foraminous surface being adapted t transport the porous substrate through said nip region, means for supplying foam to said foam discharge head with pressure sufficient to discharge foam through said dischharge openings to impregnate the porous substrate, and means for urging said foam discharge head toward said foraminous surface to apply a force to the porous substrate to urge the porous substrate into sealed relation with said surface plate so that foam is substantially prevented from accumulating at the interface of said foam discharge head and the porous substrate as the porous substrate is transported through said nip region, said foam discharge head being mounted to a hinged plate to enable the urging of said foam dischharge head toward said foraminous surface.

2. The apparatus of claim 1 in which said means for urging comprises a pneumatic means.

3. The apparatus of claim 1 comprising means for controlling the force applied to the porous substrate by said means for urging.

4. Apparatus for impregnating a porous substrate with a foam comprising a foam discharge head having a surface plate adapted with one or more dischharge openings for the discharge of foam therethrough, a foraminous surface positioned opposite said dischharge openings to define a np region, said foraminous surface being adapted to transport the porous substrate through said nip region, means for supplying foam to said discharge head with pressure sufficient to dischharge foam through said discharge openings to impregnate the porous substrate, and means for urging said foraminous surface toward said foam discharge head to apply a force to the porous substrate to urge the porous substrate into sealed relation with said surface plate so that foam is substantially prevented from accumulating at the interface of said foam discharge head and the porous substrate as the porous substrate is transported through sad nip region, said foam discharge head being mounted to a hinged plate so as to enable said foam discharge head to be urged toward said foraminous surface.

5. The apparatus of claim 4 in which said means for urging comprises a pneumatic means.

6. The apparatus of claim 4 comprising means for controlling the force applied to said porous substrate by said means for urging.

7. A method for impregnating a porous substrate with a foam comprising transporting the porous substrate through a nip region defined by a foraminous surface and a foam discharge head, said foam dischharge head comprising a surface plate adapted with one or more dischharge openings, where the transport of the porous substrate through said nip region causes the porous substrate to be compressed as it passes said discharge openings, said foam discharge head being mounted to a hinged plate to enable urging of said foam discharge head toward said foraminous surface, supplying foam to said discharge head with pressure sufficient to discharge foam though said discharge openings to impregnate the porous substrate, and urging said foam discharge head toward said foraminous surface to apply a force to the porous substrate to urge the porous substrate into sealed relation with said surface plate to substantially prevent foam from accumulating at the interface between said foam discharge head and the porous substrate as the porous substrate is transported through said nip region.

8. The method of claim 7 comprising controlling the force applied to the porous substrate by said foam discharge head.

9. A method for impregnating a porous substrate with a foam comprising transporting the porous substrate through a nip region defined by a foraminous surface and a foam discharge head, said foam discharge head comprising a surface plate adapted with one or more discharge openings, where the transport of the porous substrate through said nip region causes the porous substrate to be compressed as it passes said discharge openings, said foam dischhargе head being mounted to a hinged plate to enable urging of said foam discharge head toward said foraminous surface, supplying foam to sad discharge head with pressure sufficient to discharge foam through said discharge openings to impregnate the porous substrate, and urging said foraminous surface toward said foam discharge head to apply a force to the porous substrate to urge the porous substrate into sealed relation with said surface plate to substantially prevent foam from accumulating at the interface between said foam discharge head and the porous substrate as the porous substrate is transported through said nip region.

10. The method of claim 9 comprising controlling the force applied to the porous substrate by said foraminous surface.

* * * * *